US005226083A

United States Patent [19]

Taguchi

[11] Patent Number: 5,226,083

[45] Date of Patent: Jul. 6, 1993

[54] COMMUNICATION APPARATUS FOR SPEECH SIGNAL

[75] Inventor: Tetsu Taguchi, Tokyo, Japan

[73] Assignee: NEC Corporation, Tokyo, Japan

[21] Appl. No.: 662,692

[22] Filed: Mar. 1, 1991

[30] Foreign Application Priority Data

Mar. 1, 1990 [JP] Japan ..... 2-50951

[51] Int. Cl.[5] ..... G10L 5/00

[52] U.S. Cl. ..... 381/36

[58] Field of Search ..... 381/49, 47, 46, 38, 381/36, 35, 31, 30

[56] References Cited

U.S. PATENT DOCUMENTS

| | | | |
|---|---|---|---|
| 4,486,899 | 12/1984 | Fushikida | 381/36 |
| 4,797,926 | 1/1989 | Bronson et al. | 381/36 |
| 4,879,748 | 11/1989 | Picone et al. | 381/49 |
| 4,980,916 | 12/1990 | Zinser | 381/36 |
| 5,048,088 | 9/1991 | Taguchi | 381/38 |
| 5,091,944 | 2/1992 | Takahashi | 381/36 |

*Primary Examiner*—Emanuel S. Kemeny
*Attorney, Agent, or Firm*—Sughrue, Mion, Zinn, Macpeak & Seas

[57] ABSTRACT

A speech signal communication apparatus used in a confidential communication system, which performs blockwise processing to achieve a high level of confidentiality, free from waveform discontinuity at the block boundary in a restored speech signal. This apparatus includes a calculating unit for calculating linear predictive coefficients of the input speech signal and a filter to inversely filter the speech signal by using the linear predictive coefficients. The filter flattens the spectral envelope of the input speech signal and produces a predictive residual signal therefrom. This apparatus also includes a removing unit for adaptively removing a low power frequency component from the frequency components of the predictive residual signal. The removing unit uses the linear predictive coefficients to determine which frequency components are to be removed. The linearly predictive coefficients are then converted into a signal having the removed frequency components therein. This converted signal is combined with the removed predictive residual signal from the removing unit, thereby producing a waveform continuous at block boundaries in a restored speech signal.

14 Claims, 6 Drawing Sheets

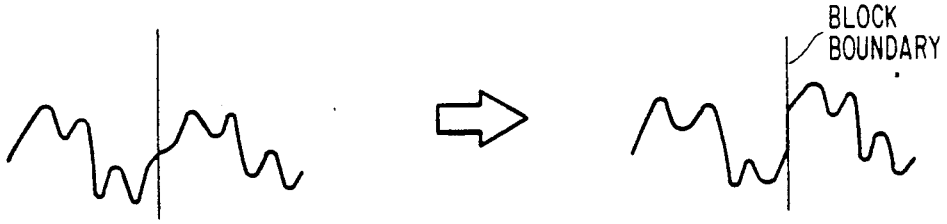
FIG. 1(a) FIG. 1(b)
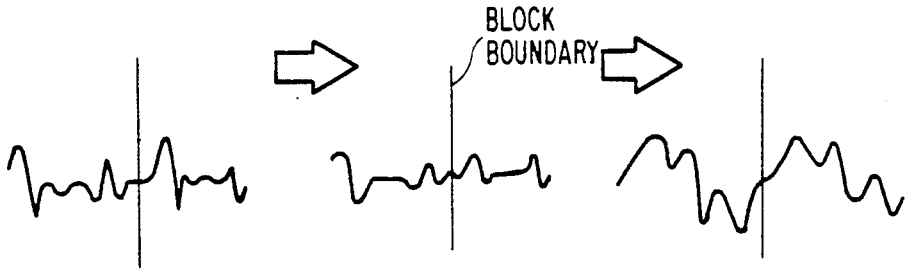
FIG. 3(a) FIG. 3(b) FIG. 3(c)
FIG. 4
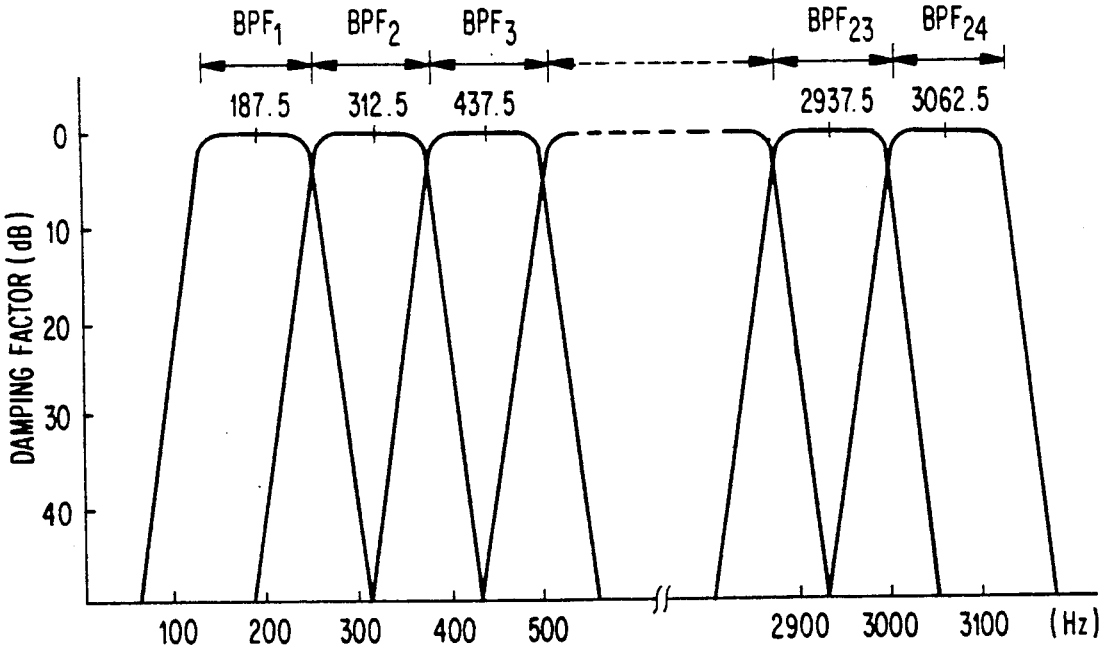

COMMUNICATION APPARATUS FOR SPEECH SIGNAL

BACKGROUND OF THE INVENTION

The present invention relates to a communication apparatus, and more particularly to a speech signal communication apparatus for use in a confidential communication system.

Requirements for a confidential communication system are high sound quality and high confidentiality under the limitation of transmission capacity of a given transmission line, such as a public communication telephone line, and these requirements are in a trade-off relationship.

The deformation processing and restoration processing of a speech signal for a confidential communication system are performed by linear arithmetic processes and, where high confidentiality and accordingly complex processing are required, entails blockwise processing, such as FFT.

A prior art confidential communication system entailing complex blockwise processing, when it deforms, transmits and restores a speech signal having a waveform shown in FIG. 1(*a*) for instance, is limited in the reproducibility of the waveform because of the constraint of the arithmetic capacity and the nonlinearity of the transmission line among other things, and accordingly has the disadvantage that discontinuity of the waveform arises on the block boundary in the restored speed signal, as shown in FIG. 1(*b*), resulting in poor sound quality.

SUMMARY OF THE INVENTION

An object of the present invention is to provide a speech signal communication apparatus for use in a confidential communication system, which is capable of performing blockwise processing in order to achieve high level confidentiality, free from discontinuity of the waveform at the block boundary in a restored speech signal, and furthermore capable of faithfully transmitting important speech components including, for instance, a Formant component.

Thus, according to the invention, there is provided a communication apparatus for an input speech signal equipped with calculating means for calculating linear predictive coefficients of the input speech signal; filtering means for inversely filtering the speech signal by using the linear predictive coefficients calculated by the calculating means in order to flatten the spectral envelope of the input speech signal and for producing a predictive residual signal; removing means for adaptively removing a low power frequency component out of frequency components of the predictive residual signal delivered from the filtering means by using the linear predictive coefficients calculated by the calculating means; means for converting the linear predictive coefficients calculated by the calculating means into a signal having the removed frequency components; and means for combining the signal from the converting means and the removed predictive residual signal from the removing means.

This configuration of the present invention make it possible to faithfully transmit an important speech component including the Formant component without having to increase a data amount of transmitted information, and thereby to provide a communication apparatus for a speech signal which ensure high sound quality.

BRIEF DESCRIPTION OF THE DRAWINGS

FIGS. 1(*a*) and 1(*b*) are waveform diagrams of an input speech signal and a restored speed signal for explaining operation of a prior art communication apparatus;

FIGS. 3(*a*), 3(*b*) and 3(*c*) are waveform diagrams for explaining operation of a communication apparatus according to the invention;

FIG. 4 is a diagram illustrating filtering characteristics of a band-pass filter bank in FIG. 2;

DETAILED DESCRIPTION OF THE PREFERRED EMBODIMENTS

Figure 2:
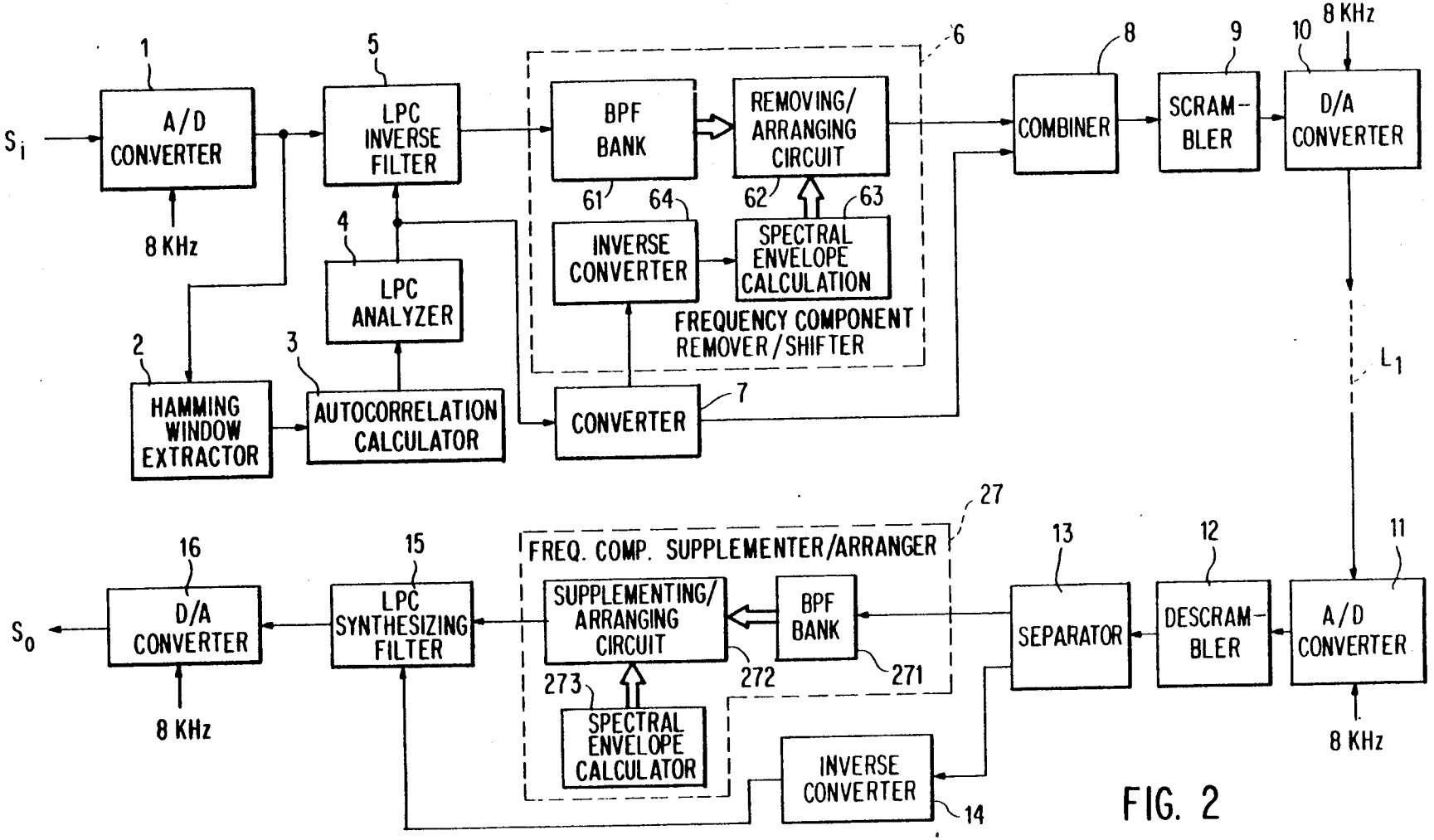
FIG. 2 is a block diagram of a first embodiment according to the present invention.

FIG. 2 is a block diagram illustrating a first preferred embodiment of the present invention.

In the embodiment shown in FIG. 2, a communication apparatus for a speech signal on a transmitting part will be described, first. An input speech signal Si to be transmitted is band-limited up to 4 KHz. It is sampled by an A/D converter 1 with a sampling frequency of 8 KHz and quantized into a required number of bits.

A Hamming window extractor 2 processes the output signal of the A/D converter 1 by a Hamming window function having 30 ms periods every 20 m cycles. An autocorrelation calculator 3 calculates an B autocorrelation coefficient sequence of the signal waveform blocked by the Hamming window extractor 2. Using this autocorrelation coefficient sequence, a LPC analyzer 4 calculates $\alpha$ parameters, corresponding to the LPC coefficients of each block of the signal waveform.

A LPC inverse filter 5, which receives as its coefficients the $\alpha$ parameters supplied by the LPC analyzer 4, inversely filters the output signal of the A/D converter 1 to produce a predictive residual signal on the basis of the LPC analysis by the LPC analyzer 4. This predictive residual signal results from flattening the spectral envelope of the input speech signal.

The frequency component remover/arranger 6 removes less-effective or meaningless frequency components from the residual signal delivered from the LPC inverse filter 5 to reduce a data amount of transmitting information, and arranges the remaining frequency components in a predetermined frequency range, for example, other than 1500 to 2125 Hz. The frequency component remover/arranger 6 is a characteristic part of the present invention, and will be described in detail elsewhere.

A converter 7 converts a frequency range of a signal representative of the $\alpha$ parameters from the LPC analyzer 4, to within the frequency range of 1500 to 2125 Hz. A method for transmitting the $\alpha$ parameters is similar to a transmitting method for the LSP parameter, described in the U.S. Pat. No. 4,817,141 "CONFIDENTIAL COMMUNICATION SYSTEM" to the present inventor, issued on Mar. 28, 1989.

A combiner 8 combines the signals delivered from the frequency component remover/arranger 6 and the converter 7. The combined signal from the combiner 8 is scrambled by a scrambler 9 by FET scrambling, for instance, on the frequency axis. The scrambled signal is analogized by a D/A converter 10 and sent out to a transmission path L.

Then, in a receiving part of the embodiment, the received signal transmitted over the transmission path L is digitized by an A/D converter 11, and descrambled by a descrambler 12. A separator 13 separates the descrambled received signal from the descrambler 12 into a signal component of the frequency range of 1500 to 2125 Hz, which is representative of the $\alpha$ parameters, and another signal component of the remaining frequency range which is representative of the residual signal. An inverse converter 14 performs a conversion inverse to that by the converter 7, and inversely converts the signal of the frequency range of 1500 to 2125 Hz, into the $\alpha$ parameters. A LPC synthesizing filter 15, which has the $\alpha$ parameters as its coefficients, is supplied with the residual signal from the separator 13 via a frequency component supplementer/arranger 27, and synthesizes a digital restored speech signal, which is analogized by a D/A converter 16 to be supplied as a restored speech signal So. The frequency component supplementer/arranger 27 will be also described in detail elsewhere.

If, on the transmitting part, the waveform of the residual signal delivered from the LPC inverse filter 5 is as shown in FIG. 3(*a*), the residual signal restored on the receiving part and supplied from the separator 13 will have discontinuity in waveform on the block boundary as shown in FIG. 3(*b*). As this discontinuity, however, is smoothed by the filtering by the LPC synthesizing filter 15, the output speech signal So is smooth in waveform even on the block boundary as shown in FIG. 3(*c*) and accordingly has high sound quality.

In FIG. 2 showing the embodiment of the present invention, the input speech signal Si is separated into the LPC coefficients representative of the spectral envelope information thereof, and the residual signal representative of its spectral fine structure information. Further, after the separation, all processing is performed at a waveform domain.

Now will be described in detail the frequency component remover/arranger 6. As shown in FIG. 2, it includes a band pass filter (BFP) bank 61, a removing/arranging circuit 62, a spectral envelope calculator 63 and an inverse converter 64. The inverse converter 64 is identical with the inverse converter 14 on the receiving part. The predictive residual signal from the LPC inverse filter 5 is supplied to the BPF bank 61. As shown in FIG. 4, the BPF bank 61 comprises 24 band-pass filters each having a pass band width of 125 Hz wherein all of the bank's filters differ in the center frequency from one another and are so set as to adjoin one another in pass band, and the whole bank passes components having frequencies of 125 to 3125 Hz. Thus, the center frequencies of the individual band-pass filters of the BPF bank 61 are 187.5 Hz, 312.5 Hz, . . . , 3062.5 Hz. These 24 band-pass filters can be readily realized with, for example, transversal filters.

Figure 5:
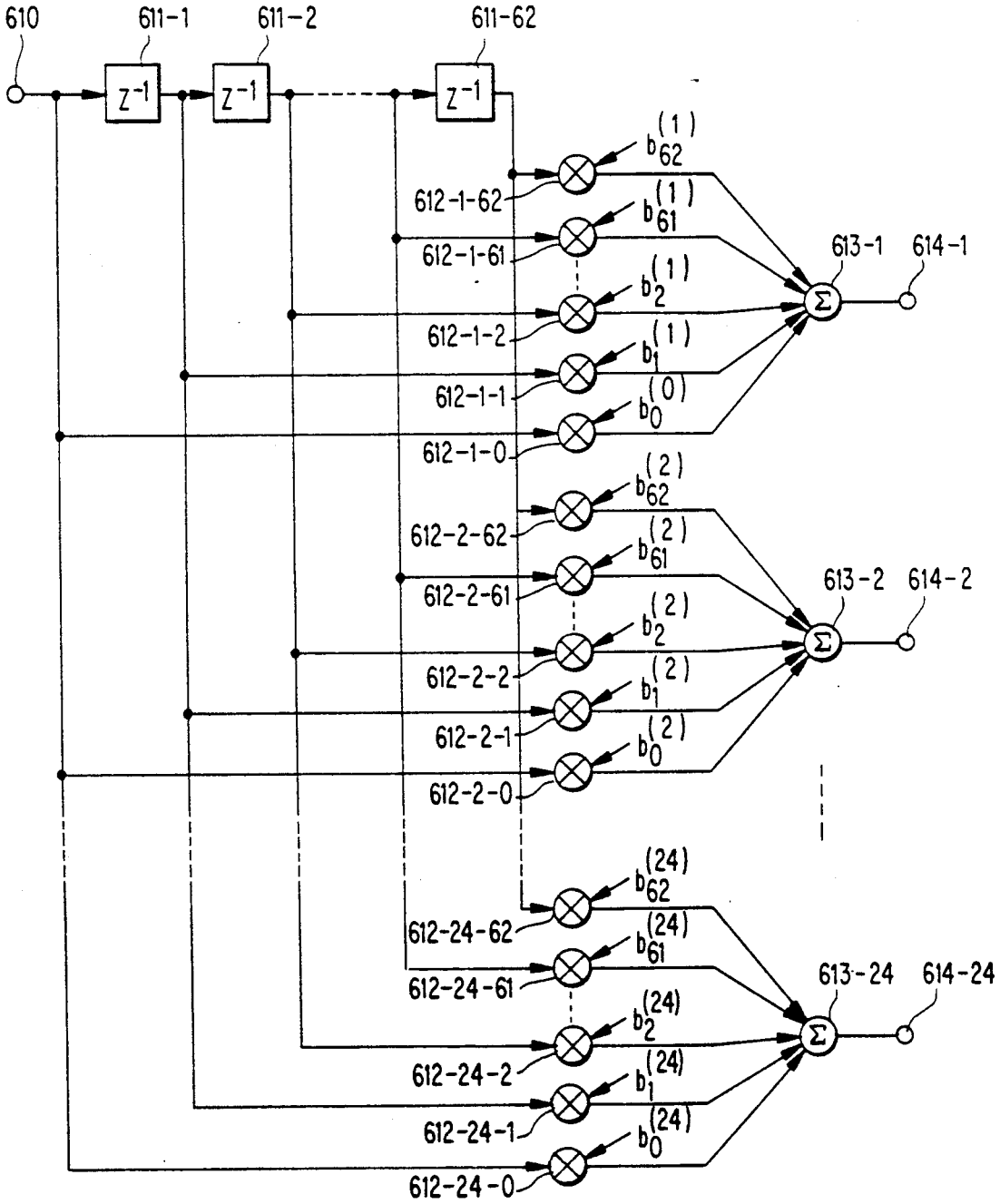
FIG. 5 is a diagram illustrating the circuit configuration of the band-pass filter bank in FIG. 2.

FIG. 5 is a block diagram of the circuit configuration of the BPF bank 61 in detail. The illustrated BPF bank 61 has an input terminal 610, unit delay elements 611-1, 611-2, . . . , 611-62, multipliers 612-1-0, 612-1-1, . . . , 612-1-62, 621-2-0, 612-2-1, . . . , 612-2-62, . . . , 612-24-0, 612-24-1, 612-24-2, . . . , 612-24-61, 612-24-62, accumulators 613-1, 613-2, . . . , 613-24, and output terminals 614-1, 614-2, . . . , 614-24. The output terminals 614-1, 614-2, . . . , 614-24 are the output terminals of the 24 band-pass filters, and respectively correspond to the band-pass filters whose center frequencies are 187.5 Hz, 312.5 Hz, . . . , 3062.5 Hz. The predictive residual signal delivered from the LPC inverse filter 5 is supplied to the input terminal 610. The unit delay elements 611-1, 611-2, . . . , 611-62 are driven at 8 KHz, and stock a total of 62 samples of the residual signal. The multipliers 612-1-0 to 62, 612-2-0 to 62, . . . , 612-24-0 to 62 are also supplied with constants $b_0^{(1)}$ to $b_{62}^{(1)}$, $b_0^{(2)}$ to $b_{62}^{(2)}$, . . . $b_0^{(24)}$ to $b_{62}^{(24)}$. These constants, which are the filter coefficients of transversal filters, are determined and provided in advance by Fourier-transforming the frequency characteristics of the individual band-pass filters, shown in FIG. 4, by a method well known to those skilled in the art. The accumulators 613-1 to 24 total the respectively supplied multiplier outputs, and supply the respective results to the output terminals 614-1 to 24 as filter output waveforms.

The outputs of the 24 individual band-pass filters of the BPF bank 61 are supplied to the removing/arranging circuit 62. The inverse converter 64 produces the $\alpha$ parameters in the same manner as the inverse converter 14 does, and supplies them to the spectral envelope calculator 63. The spectral envelope calculator 63 calculates spectral envelope from the $\alpha$ parameters by a method well known to those skilled in the art using the following Equation (8.102) in L.R. Rabiner and R.W. Schafter, "Digital Processing of Speech Signal", Prentice-Hall, page 433:

$$H(e^{jw}) = \frac{G}{1 - \sum_{k=1}^{P} \alpha_k e^{-jwk}} \tag{8.102}$$

where $H(e^{jw})$ is the spectral envelope level, or the power, of speech at an angular frequency of w; $\alpha_k$ k=1, . . . , p) is the $\alpha$ parameter; p, its predictive degree; and G, the gain. In this preferred embodiment, since the absolute value of the spectral envelope is not needed but only the relative value for each frequency is required, the gain G is treated as being 1.0. The angular frequency w is figured out by translating the speech sampling frequency of 8 kHz into 2 $\pi$(rad). A frequency of 187.5 Hz, for instance, is an angular frequency of 187.5 $\pi$/4000 (rad). The spectral envelope calculator 63 supplies the 24 power values of the spectral envelope data:

$$|H(e^{j187.5\pi/4000})|,\ |H(e^{j312.5\pi/4000})|,\ \ldots,\ |H(e^{j3062.5\pi/4000})|$$

to the removing/arranging circuit 62.

The removing/arranging circuit 62, utilizing the power values of 187.5 Hz, 312.5 Hz, . . . , 3062.5 Hz of the spectral envelope data delivered from the spectral envelope calculator 63, selects the five smallest power values. These five correspond to the components to be removed. Of course, the maximum power in the frequency range of 125 Hz to 250 Hz may be selected in place of the power corresponding to the central frequency 187.5 Hz. The removing/arranging circuit 62 frequency-shifts the remaining frequency components to two frequency ranges, i.e., a frequency range of 125–1500 Hz and a frequency range of 2125–3125 Hz. This shifting is accomplished by multiplication with a local frequency and signal and filtering the multiplication results, that is well known to those skilled in the art.

Figure 6:
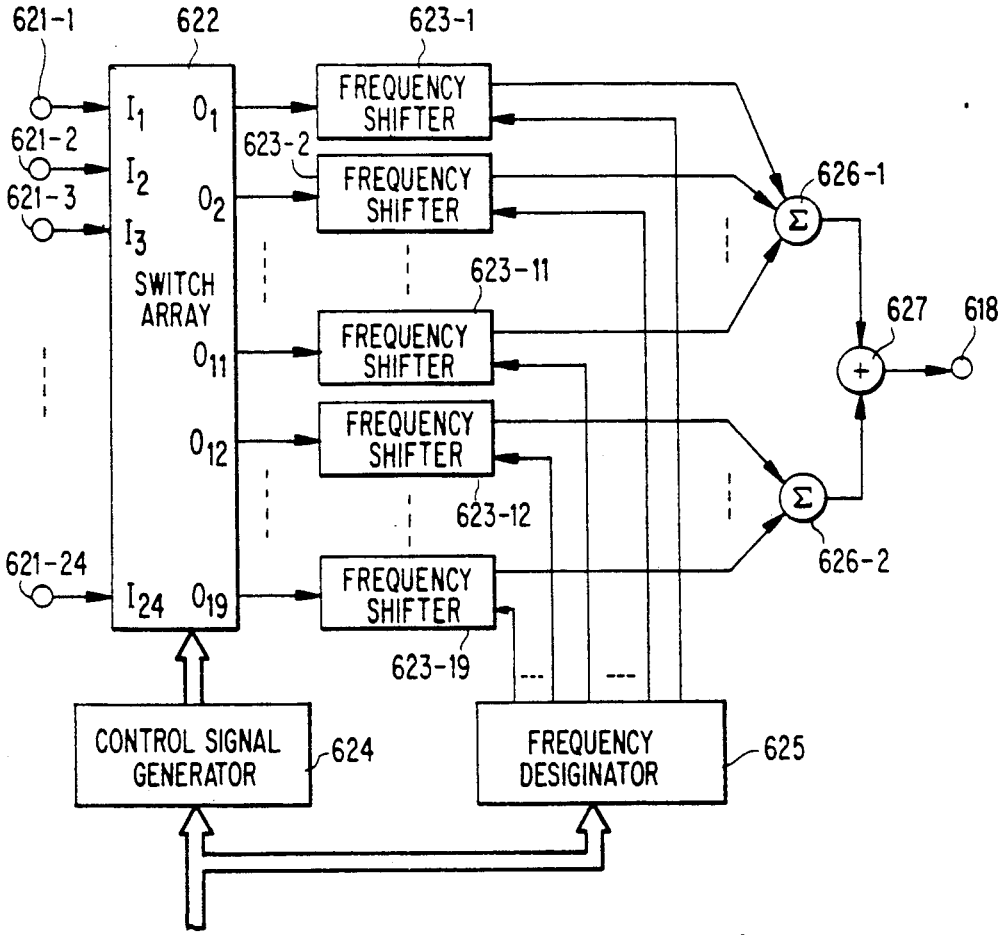
FIG. 6 is a diagram illustrating the circuit configuration of a frequency removing/arranging circuit in FIG. 2.

FIG. 6 is a block diagram of the removing/arranging circuit 62. In FIG. 6, the 24 power values of the spectral envelope data supplied from the spectral envelope calculator 63 are entered into a control signal generator 624 and a frequency designator 625. The control signal generator 624 detects the smallest five of the 24 power values of the spectral envelope data and generates control signals to a switch array 622 to supply the remaining 19 the components to respective frequency shifters 623-1 to 623-19. Thus, the switch array 622 has 24 input terminals 621-1 to 621-24. ($I_1$ to $I_{24}$) and 19 outputs $O_1$ to $O_{19}$. Thus the control signal generator 624 generates control signals so as to connect one of the 24 input terminals $I_1$ to $I_{24}$ to the 19 output terminals $O_1$ to $O_{19}$ of the switch array 622 to be described below. If, for instance, $O_s$ ($s=1, 2, \ldots, 18$) is connected to $I_t$ ($t \geqq s$, $t<24$), $O_{s+1}$ will be connected to one of $I_{t+1}$, $I_{t+2}$, $I_{t+3}$, $I_{t+4}$, $I_{t+5}$ and $I_{t+6}$ ($t+6 \leqq 24$). Therefore, the outputs of the BPF bank 61, except the frequency band components having the smallest five power values of the spectral envelope data, are supplied to the frequency shifters 623-1 to 623-19. The frequency shifters 623-1 to 623-19 frequency-shift the respective received frequency band components to arrange them into two frequency ranges (groups), i.e., the group having frequency of 125 to 1500 Hz and the other having frequency of 2125 to 3125 Hz. The frequency shifters 623-1 to 623-19 perform frequency-shifting on the basis of designating signals supplied from a frequency designator 625. The outputs of the frequency shifters 623-1 to 623-11 are supplied to an accumulator 626-1 to make up the one group having frequencies of 125 Hz to 1500 Hz, and the outputs of the frequency shifters 623-12 to 623-19 are supplied to an accumulator 626-2 to make up the other group having frequencies of 2125 Hz to 3125 Hz. The outputs of the accumulators 626-1 and 626-2 are added by an adder 627, and supplied to the combiner 8 (FIG. 2) via an output terminal 618.

The frequency designator 625 generates the designating signals to the frequency shifters 623-1 to 623-19, to designate respective required frequency shift amounts, on the basis of the 24 power values of the spectral envelope data supplied from the spectral envelop calculator 63. In detail, the frequency designator 625 detects the smallest five of the 24 power values, calculates the frequency shift amounts of each of the 19 frequency bands on the basis of the detection results, converts the amounts into phase quantities varying in 1/8000 second, and supplies the converted results to the frequency shifters 623-1 to 623-19. It generates its output as values representing $\pi/2$ (rad) by 1024.0.

Figure 7:
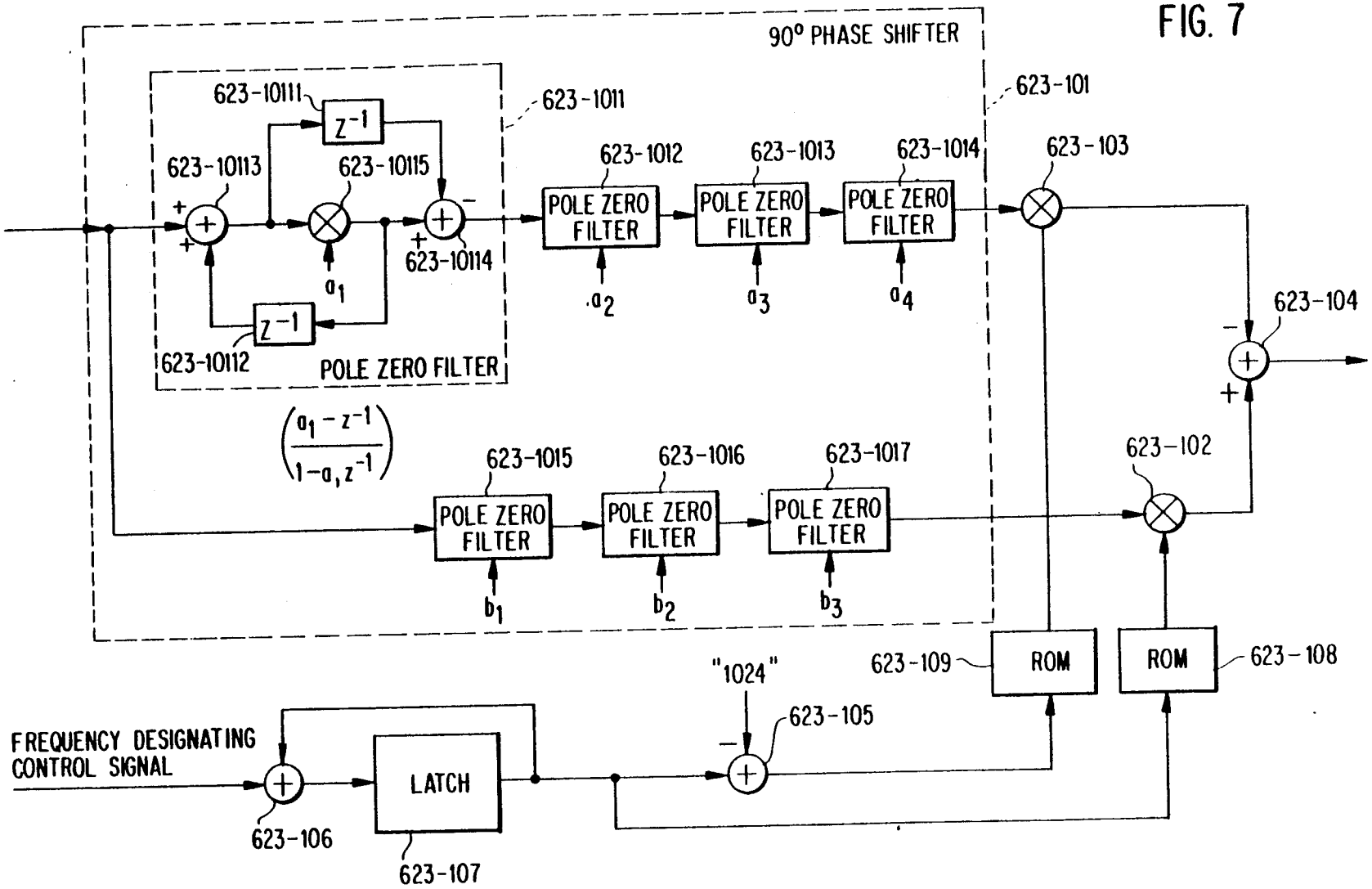
FIG. 7 is a diagram illustrating the circuit configuration of the frequency shifter in FIG. 6.

Next will be described in detail the circuit configuration of the frequency shifter 623-1 with reference to FIG. 7. The frequency shifter 623 has a 90° phase shifter 623-101 for delivering two outputs having a 90° phase difference therebetween, multipliers 623-102 and 623-103 for multiplying the outputs from the shifter 623-101 with trigonometric functions, an adder 623-104 for adding the multiplied outputs and trigonometric function generating means including adders 623-105 and 623-106, a latch 623-107, and ROM's 623-108 and 623-109. The 90° phase shifter 623-101 further includes a plurality of pole-zero filters 623-1011 to 1017 for shifting a signal phase. The pole-zero filters 623-1011 to 1017 have the same configuration and differ from one another only in filter coefficients in accordance with phase shift amounts. The phase shift amounts of the respective pole-zero filters are determined such that the two outputs of the phase shifters 623-101 have the 90° phase difference. In the pole-zero filters 623-1011 to 1017 are set in advance filter coefficients $a_1$, $a_2$, $a_3$, $a_4$, $b_1$, $b_2$ and $b_3$. The pole-zero filter 623-1011 comprises unit delay elements 623-10111 and 623-10112, adders 623-10113 and 623-10114, and a multiplier 613-10115. The aforementioned filter coefficients $a_1$ to $a_4$ and $b_1$ to $b_3$ are figured out by a design technique based on an oval function well known to those skilled in the art.

A frequency component supplied via the output terminal $O_1$ of the switch array 622 is provided to the 90° phase shifter 623-101. This frequency component generates two outputs, differing in phase from each other by 90°, for every frequency of the frequency band. The output having an advanced phase is supplied to the multiplier 623-102, and the other having a lagged phase, to the multiplier 623-103. To the multiplier 623-102 is also supplied a cosine wave whose frequency corresponds to a frequency shift amount, and to the multiplier 623-103, a sine wave. From the output of the multiplier 623-102 is subtracted that of the multiplier 623-103 by the adder 623-104, and the result is supplied as a component of 125 to 250 Hz in frequency range. Both the ROM's 623-108 and 623-109 are 4096-word ROM's, into which sine wave coefficients are written in a form in which the address corresponds to the phase angle. The shift amount designating datum supplied from the frequency designator 625 is provided to the adder 623-106, whose output is supplied to the latch 623-107. The output of the latch 623-107 is supplied back to the adder 623-106 as well as to the adder 623-105 and the ROM 623-108. If the shift amount designating datum is, for instance, "128" corresponding to 125 Hz, the output of the latch 623-107 will vary from 128 to 256, 384, . . . , 3968, 0, 128, . . . . The output of the adder 623-105 will be caused by the subtraction of a fixed value "1024" to vary from −896 to −768, −640, . . . , 2944, 3078, 3202, . . . .

Next will be described in detail the frequency component supplementer/arranger 27 on the receiving part. As shown in FIG. 2, the frequency component supplementer 27 includes a band pass filter (BPF) bank 271, a supplementing/arranging circuit 272 and a spectral envelope calculator 273. The spectral envelope calculator 273 is identical with the spectral envelope calculator 63 on the transmitting part.

The BPF bank 271, which is a filter bank covering the frequency ranges of 125 Hz to 1500 Hz and 2125 Hz to 3125 Hz, consists of 19 band-pass filters whose pass band width is 125 Hz. The output of the BPF bank 271 is supplied to the supplementing/arranging circuit 272, which, using spectral envelope data supplied from the spectral envelope calculator 273, shifts and rearranges the fluency of the output of the BPF bank 271 by a method well known to those skilled in the art. The frequency component removed by the frequency component remover/arranger 6 is supplemented with, for instance, white noise.

Figure 8:
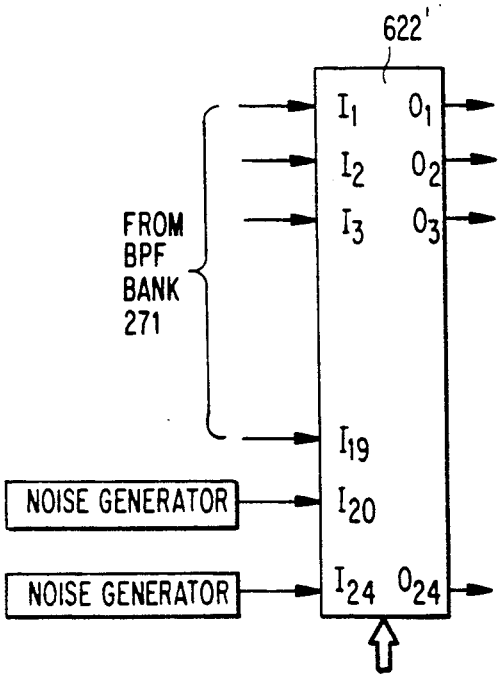
FIG. 8 is a block diagram illustrating a partial circuit configuration of a frequency supplementing/arranging circuit in FIG. 2.

The supplementing/arranging circuit 272 can be readily realized by adding five white noise generators to a similar configuration of the removing/arranging circuit 62 shown in FIG. 6. As shown in FIG. 8, a part equivalent to the switch array 622 (FIG. 6) has 24 inputs and outputs, and the 19 outputs out of the 24 inputs are connected to the outputs of the BPF bank 271 and the five inputs are connected to the five white noise generators, every one of which has a frequency bandwidth of 125 Hz.

Next, a second preferred embodiment of the present invention will be described with reference to FIG. 9. The second embodiment performs processing by utilizing spectrum domain.

Figure 9:
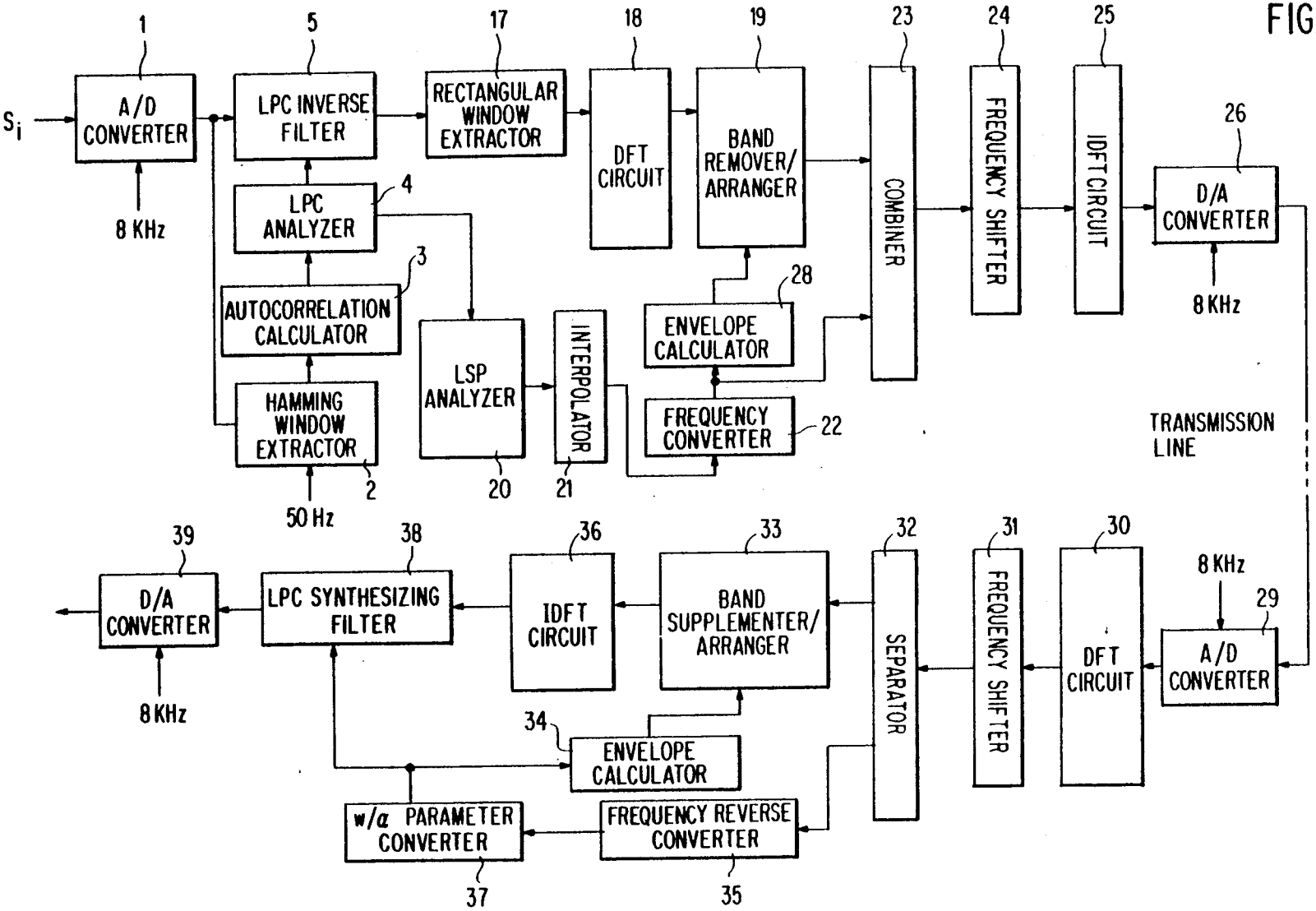
FIG. 9 is a block diagram of a second preferred embodiment of the invention.

The second embodiment shown in FIG. 9 comprises an A/D converter 1, a Hamming window extractor 2, an auto-correlation calculator 3, an LPC analyzer 4, an LPC inverse filter 5, a rectangular window extractor 17, a DFT circuit 18, a band remover/arranger 19, an LSP analyzer 20, an interpolator 21, a frequency converter 22, a combiner 23, a frequency shifter 24, an IDFT circuit 25, a D/A converter 26, and an envelope calculator 28 on a transmitting part.

This preferred embodiment is the same as the first embodiment shown in FIG. 2 in that the LPC analyzer 4 produces the $\alpha$ parameters, and the LPC inverse filter 5 produces the predictive residual signal.

The rectangular window extractor 17 extracts the residual signal delivered from the LPC inverse filter 3 by rectangular window processing at 32 ms intervals (the repeat frequency is 31.25 Hz) to produce a blocked signal.

The DFT circuit 18 converts the signal waveform blocked by the rectangular window 17 into a frequency spectrum by discrete Fourier transform at (8000-31.25=) 256 points. The band remover/arranger 19 detects low-power frequency components by using the spectral envelop data at 31.25 Hz intervals supplied from the envelope calculator 28, removes a frequency band of 625 Hz, i.e., 20 frequency samples, and arranges the remaining frequency samples in frequency ranges of 125 to 1500 Hz and of 2125 to 3125 Hz. The principle of the envelope calculator 27 is equivalent to that of the spectral envelope calculators 63 and 273.

The LSP analyzer 20 converts the $\alpha$ parameters from the LPC analyzer 4 into line spectral pair (LSP) coefficients, representing a line spectrum. The LSP coefficients delivered from the LSP analyzer 20 are interpolated by the interpolator 21 at 31.25 Hz intervals, and the interpolated LSP coefficients of 0 to 4 KHz are frequency-converted by the frequency converter 22 into a frequency range of 1500 to 2125 Hz. The combiner 23 combines the output signals from the band remover/arranger 19 and the frequency shifter 22.

The combined signal delivered from the combiner 23 is frequency-shifted by the frequency shifter 24 and is transformed by inverse discrete Fourier transform by the IDFT circuit 25. By such transformation, the signal having a frequency domain is converted into the signal having a time domain, in other words, into a waveform signal. The transformed signal is converted into an analog signal by the D/A converter and to sent out to a transmission line.

Further, as shown in FIG. 9, a receiving part of the second embodiment comprises an A/D converter 29, a DFT circuit 30, a frequency shifter 31, a separator 32, a band supplementer/arranger 33, an envelope calculator 34, a frequency reverse converter 35, an IDFT circuit 36, a w/$\alpha$ parameter converter 37, a LPC synthesizing filter 38 and a D/A converter 39.

On the receiving part, the residual signal, (in which frequency components corresponding to 625 Hz in total is removed by the band remover/arranger 19 on the transmitting part) and the LPC coefficients are restored from the transmitted signal, and a speech signal is synthesized from the restored residual signal by the LPC synthesizing filter 38. In this embodiment, DCT may as well be used in place of DFT.

As hitherto described, the present invention provides a communication apparatus for a speech signal capable of eliminating the discontinuity of a waveform on the boundary of signal processing blocks by that a transmitting part transmits a speech signal by combination of linear predictive coefficients and a predictive residual signal and a receiving part restores a speech signal by linear predictive coefficient synthesizing filter which filters the residual signal in accordance with the linear predictive coefficients.

Furthermore, by removing a less-sufficient frequency component from the residual signal to be transmitted, sound quality is more improved.

What is claimed is:

1. A communication apparatus for a speech signal comprising:

calculating means for receiving an input speech signal and for calculating linear predictive coefficients representative of an envelope of said input speech signal;

filtering means for inversely filtering said input speech signal on the basis of said linear predictive coefficients calculated by said calculating means to produce a residual signal, said residual signal containing a plurality of frequency components within a prescribed frequency region;

removing means for removing a frequency component having a low power from said residual signal delivered from said filtering means on the basis of said linear predictive coefficients calculated by said calculated means to produce a removed residual signal; and combining means for combining a signal representative of said linear predictive coefficients from said calculating means and said removed residual signal from said removing means to produce an output signal corresponding to said input speech signal.

2. A communication apparatus as claimed in claim 1, wherein said removing means includes:

a filter bank having a plurality of frequency bands for receiving said residual signal delivered from said filtering means and for extracting a plurality of outputs associated with said plurality of frequency bands, said plurality of frequency bands corresponding to said plurality of frequency components contained in said residual signal;

power calculating means for calculating power of an output of each frequency band on the basis of said linear predictive coefficients delivered from said linear predictive coefficient calculating means; and selecting means coupled to said power calculating means for selecting frequency bands having high power in the outputs of said filter band and for delivering selected frequency bands as said removed residual signal.

3. A communication apparatus, as claimed in claim 2, wherein said removing means further includes means for shifting frequency bands of said selected frequency bands selected by said selecting means and for arranging shifted frequency bands to leave out a predetermined frequency range in said prescribed frequency region; and said combining means sets the signal representative of said linear predictive coefficients into said predetermined frequency range.

4. A communication apparatus as claimed in claim 1 and a decoding apparatus, wherein said decoding apparatus comprises:

means for receiving said output signal and separating it into a signal representative of said linear predictive coefficients and a signal representative of said removed residual signal;

supplementing means for supplementing a predetermined frequency component in place of the removed frequency component in the removed residual signal from said separating means; and a synthesizing filter for synthesizing a speech signal in response to the linear predictive coefficients and the supplemented residual signal from said supplementing means.

5. A communication apparatus for a speech signal comprising:

a transmitting part and a receiving part, said transmitting part including, first means for calculating linear predictive coefficients of said speech signal;

second means for inversely filtering said speech signal to flatten the spectral envelope of the speech signal and for delivering a residual signal, said second means having a filtering characteristic defined by said linear predictive coefficients calculated by said first means; and third means for adaptively removing desired frequency components having a low signal level from said residual signal entered from the second means by using the linear predictive coefficients entered from said first means, said receiving means including, fourth means for supplementing a predetermined frequency component in place of said desired frequency components removed by said third means; and fifth means for synthesizing a speech signal in response to an output of said fourth means.

6. A communication apparatus as claimed in claim 1, further comprising:

an A/D converter for receiving said input speech signal and outputting a digitally converted speech signal, a window extractor for processing said digital speech signal by a Hamming window function having a 30 ms. period every 20 cycles and outputting therefrom sequences of blocked signal waveforms, said calculating means including an auto correlation calculator for receiving said blocked signal waveforms and calculating an auto correlation coefficient sequence therefrom.

7. A communication apparatus as claimed in claim 6, wherein said calculating means includes said auto correlations calculator, a LPC analyzer for receiving said auto correlation coefficient sequence and calculating alpha parameters therefrom, corresponding to the LPC coefficients of each of said blocked signal waveforms, said filtering means receiving said alpha parameters as coefficients and inversely filtering said digital speech signal based upon said alpha parameters to produce a predictive residual signal, said predictive residual signal resulting from a flattening of a spectral envelope of the input speech signal.

8. A communication apparatus as claimed in claim 7, wherein said removing means removes said low power frequency component from said residual signal to reduce an amount of transmitted data and arranges remaining frequencies components of said residual signal into a predetermined frequency range.

9. A communication apparatus as claimed in claim 8, further comprising a convertor for converting a frequency range of said alpha parameters to within said predetermined frequency range, said converted alpha parameters constituting said linear predictive coefficients used by said filtering means.

10. A communication apparatus as claimed in claim 9, further comprising a scrambler for receiving said output signal of said combining means and FET scrambling said output signal along a frequency axis, thereby outputting a scramble signal, a D/A converter for converting said scrambled signal to an analog scrambled signal to be transmitted along a transmission path.

11. A communication apparatus as claimed in claim 2, wherein said filter bank includes a plurality of band-pass filters, each of which has a corresponding one of said plurality of frequency bands, wherein each of said band-pass filters has a pass band of 125 Hz and each of said band pass filters has a different center frequency, said center frequencies being set such that said passing bands adjoin one another and said filter bank passing frequency components within a desired range.

12. A communication apparatus as claimed in claim 11, wherein said desired frequency range constitutes the frequencies between 125 Hz and 3112 Hz, said band pass filters being transversal filters.

13. A communication apparatus as claimed in claim 12, wherein said band pass filter bank includes:

an input terminal for receiving said predictive residual signal, unit delay elements serially arranged for sampling and delaying the residual signal, thereby outputting a plurality of delayed residual signals, multipliers for multiplying each of said plurality of residual signals by a corresponding constant, which constitute filter coefficients from said transversal filters, accumulator for totalling the respective multiplier outputs and supplying accumulated signals to output terminals said accumulated signals constituting filter output waveforms.

14. A communication apparatus as claimed in claim 13, said removing means further comprising:

a controlled signal generator for receiving power values of spectral envelope data supplied from said spectral envelope calculator, a frequency designator receiving said spectral envelope data, a switching array for receiving said accumulated outputs and selectively supplying said accumulated outputs, said control signal generator detecting the spectral envelope data having the smallest power values and controlling said switching array to eliminate accumulator outputs associated with said lowest power spectral envelope data from the output of said switching array, frequency shifters for receiving and frequency shifting frequency band components of the output of said switching array to arrange said band components into two frequency ranges, said frequency shifters performing shifting operations based upon designating signals supplied from said frequency designator, a first accumulator for receiving the outputs of said frequency shifters and making up a first group having frequencies within the desired range, a second accumulator for receiving outputs of a second set of said frequency shifters to make up a second group having frequencies within a second frequency range, an adder for combining the outputs of said accumulators and outputting therefrom a combined output signal.

* * * * *

UNITED STATES PATENT AND TRADEMARK OFFICE

CERTIFICATE OF CORRECTION

PATENT NO. : 5,226,083

DATED : June 6, 1993

INVENTOR(S) : Tetsu TAGUCHI

It is certified that error appears in the above-indentified patent and that said Letters Patent is hereby corrected as shown below:

Col. 6, line 62, delete "fluency", and insert --frequency--.

Col. 7, line 36, delete "envelop", and insert --envelope--;

Col. 7, line 60, after "and to" insert --be--.

Signed and Sealed this

Thirteenth Day of September, 1994

*Attest:*

*Attesting Officer*

BRUCE LEHMAN

*Commissioner of Patents and Trademarks*